US006457811B1

(12) United States Patent
Pan et al.

(10) Patent No.: US 6,457,811 B1
(45) Date of Patent: Oct. 1, 2002

(54) SELF-ALIGNED INTERCONNECT AND METHOD FOR PRODUCING SAME

(75) Inventors: Alfred I-Tsung Pan, Sunnyvale, CA (US); Terry M. Lambright, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/843,833

(22) Filed: Apr. 30, 2001

(51) Int. Cl.[7] ..... B41J 2/14; B41J 2/16
(52) U.S. Cl. ..... 347/50; 347/49
(58) Field of Search ..... 347/71, 50, 49

(56) References Cited

U.S. PATENT DOCUMENTS 4,940,998 A * 7/1990 Asakawa ..... 347/43

* cited by examiner

*Primary Examiner*—Thinh Nguyen

(57) ABSTRACT

A self-aligned interconnect significantly reduces manufacturing costs and provides important advantages in a number of specific applications begins with a single crystal substrate. The substrate is machined to accept microelectronic chips at various locations (openings) along the substrate. Corresponding chips are constructed to precisely fit the openings in the crystal substrate. To ensure precision fit, both the substrate and the chip are etched along the same crystal plane. As a result, the chips can be placed in the openings in the substrate with perfect or nearly perfect alignment in the x and y directions without expensive alignment tools. In effect, the chips and the substrate are self aligned.

20 Claims, 4 Drawing Sheets

SELF-ALIGNED INTERCONNECT AND METHOD FOR PRODUCING SAME

TECHNICAL FIELD

The technical field is microelectronic devices and methods for producing same.

BACKGROUND

Inkjet printers are commonly used to produce text and images on a variety of media such as paper, transparencies and labels, for example. A typical inkjet printer uses a carriage that holds one or more ink cartridges. The ink that is to be printed on the media is forced through small holes in a thermal inkjet chip to produce the desired text or image. Thermal inkjet chips are small crystal structures that are placed in a larger substrate to provide the desired array of inkjet printing nozzles.

To ensure accurate rendition of text and images, alignment of the thermal inkjet chips and the substrate is a critical design feature. Great care and precision must be used to make sure that the thermal inkjet chips are precisely aligned, thereby causing great expense and time in producing the thermal inkjet printer printheads. In particular, expensive precision tooling is required to align the printheads through the substrate. Second, a mismatch between a coefficient expansion for the printhead and the substrate can result in thermal induced stress on the interconnect used to electrically connect the substrate to the printheads. Additionally, the mismatch can result in misalignment between the substrate and the printheads. Third, the interconnect, the materials used from the substrate, and adhesive used to attach the printheads to the substrates are subject to failure due to the corrosive effect of ink used in inkjet printers. Fourth, the inkjet pens are sensitive to texture variations caused by waste heat from the printheads. The substrate must have a high thermal conductivity so that the waste heat can be dissipated. If the substrate has a low thermal conductivity, then the waste heat can raise temperatures of the pens, resulting in an increase in the amount of ink volumes dropped by the pens. Subsequently, a temperature differential exists among printheads so that the ink drop volumes can vary depending on their location on the substrate. Ideally, the thermal conductivity of the substrate and the printheads would be identical so that there is no temperature differential between the printheads and the substrate, resulting in consistent ink drop volumes among the printheads.

SUMMARY

A self-aligned interconnect significantly reduces manufacturing costs and provides important advantages in a number of specific applications begins with a single crystal substrate. The substrate is machined to accept microelectronic chips at various locations (openings) along the substrate. Corresponding chips are constructed to precisely fit the openings in the crystal substrate. To ensure precision fit, both the substrate and the chip are etched along the same crystal plane. As a result, the chips can be placed in the openings in the substrate with perfect or nearly perfect alignment in the x and y directions without expensive alignment tools. In effect, the chips and the substrate are self aligned.

In an embodiment, the chips may be thermal inkjet (TIJ) chips that are used to deliver ink in association with an inkjet printer.

Variation in the thickness of the chips, and to a smaller degree, any over etching, may result in variation in the height of the chip in the z direction. However, the assembly process ensures that no skew will occur in the z plane. In the context of printing, inkjet printers are not sensitive to z direction variation as long as the variation is small compared to the printhead to paper spacing.

Electrical interconnects on the chip and the conducting wiring on the silicon substrate are patterned with a matching pitch. As a result, the two parts (chip and substrate) are matched together, and the interconnect wiring, chip and the substrate will be in perfect alignment or near perfect alignment without any alignment effort.

The chips and substrate may be mated together using a glue, adhesive or solder. The adhesive may be used to reduce frictional forces and to provide a tight seal. In a specific application of an inkjet printer, the seal prevents corrosive ink from affecting delicate wiring on the chips and the substrate.

DESCRIPTION OF THE DRAWINGS

The detailed description will refer to the following drawings, in which like numerals refer to like elements, and in which.

DETAILED DESCRIPTION

A self-aligned interconnect in a microelectronic device provides accurate alignment at significantly reduced costs. The self-aligned interconnect may be used in a variety of applications, and provides significant advantages. One such application is in an inkjet printer.

A thermal inkjet printer uses the self-aligned interconnect to ensure high precision alignment of thermal inkjet (TIJ) chips in a substrate, such as a silicon substrate. A self-alignment scheme uses matching profiles of the TIJ chip and the substrate created by anisotropic wet etching along crystal planes. In an embodiment, the self-aligned interconnect begins as a large size (100) silicon substrate, which can be obtained by cutting lengthwise from a (110) silicon ingot. Typically, a single crystal seed (110) is touched to a melt surface and pulled and turned, with the single crystal ingot growing from the melt. Silicon single crystal ingots are cut into thin slices using a diamond blade saw and then surfaces of the slices are lapped, etched, and heat-treated. The shaped thin slices go through the processes of polishing, cleaning and inspection. The silicon substrate used for the self-aligned interconnect need not be a high quality wafer, which is typically referred to as a prime wafer. Instead, a lower grade test/monitor wafer may be used for the substrate. The monitor wafers are substantially the same as prime wafers with respect to cleanliness, and in some cases flatness; other specifications are generally less rigorous.

Figure 1:
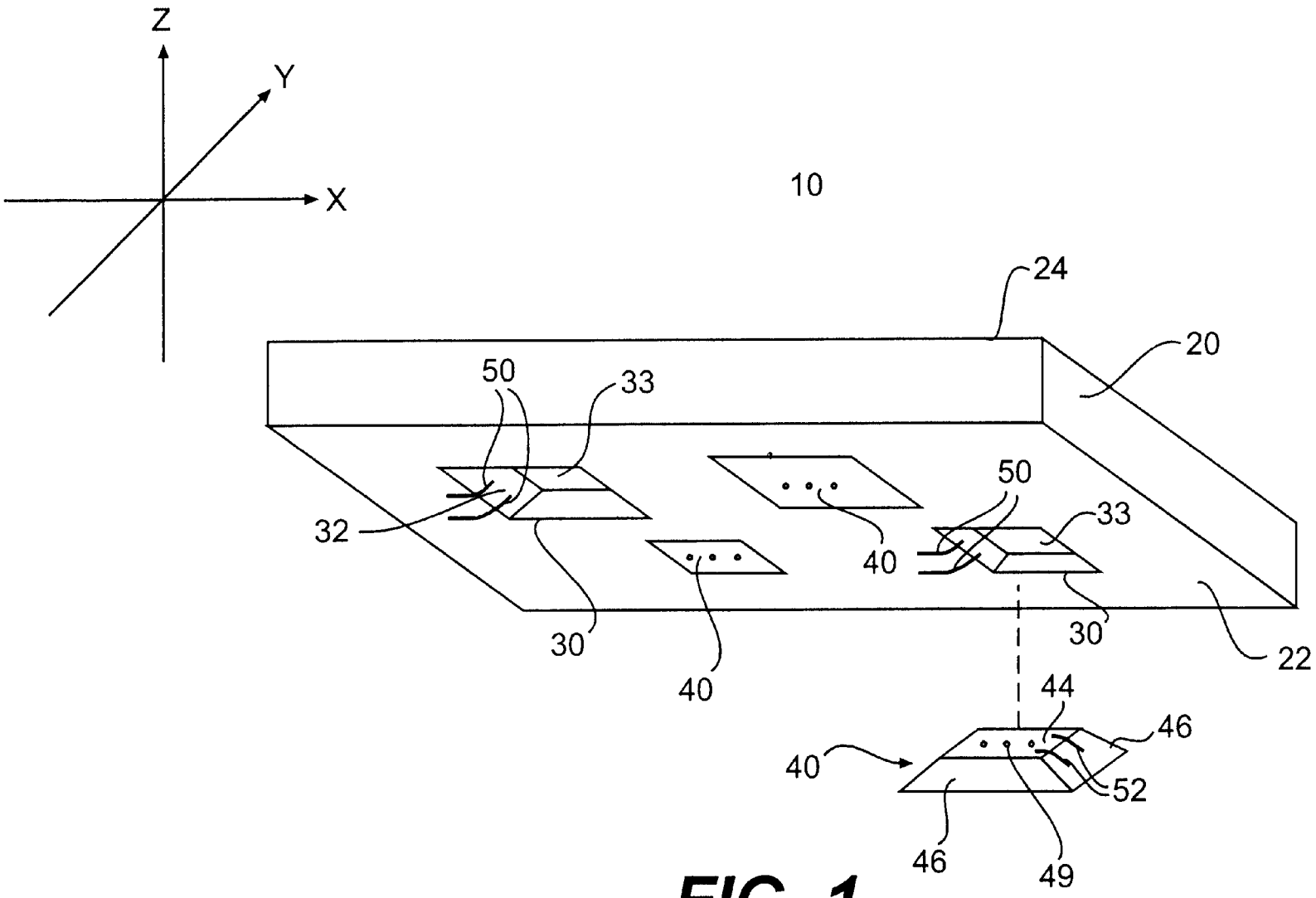
FIG. 1 shows a self-aligned interconnect having a substrate and matching chips.

FIG. 1 is a perspective view of a self-aligned interconnect 10. The self-aligned interconnect 10 includes a substrate 20 having a bottom or mounting side 22 and a top side 24. The bottom side 22 receives ink from the inkjet printer, and the top side 24 faces the media (e.g., paper) on which desired text or images are to be printed. Cut into the substrate 20 are a plurality of pockets 30, each of which are designed to carry a TIJ chip 40. Each of the pockets 30 may include an aperture 33 that provides a complete passage, or hole from the bottom side 22 to the top side 24. Each of the pockets 30 in the silicon substrate 20 also includes first side profiles 32 formed in the pocket 30. The side profiles 32 may be cut at an angle, such as 57°, for example. The TIJ chip 40 includes a side profile that is complimentary to the side profiles 32. In particular, the TIJ chip 40 includes second side profiles 46, each having a profile, or slope that matches a corresponding side profile 32. The complimentary side profiles 32, 46 result in the TIJ chip 40 being positioned in near perfect azimuthal-alignment with at least two orthogonal planes of the substrate 20.

The TIJ chip 40 also includes holes 49 through which ink drops are ejected through top surface 44, wiring 52 to effectuate ink transfer, and a base surface 42 in contact with an ink supply (not shown). In FIG. 1, the TIJ chip 40 and the pockets 30 are shown with two wire leads (i.e., two each of 52 and 50, respectively). However, any number of wiring leads may be patterned on the TIJ chip 40 and on the substrate 20 (i.e. at the pockets 30).

The substrate 20 and the TIJ chip 40 can be made from a single crystal semiconducting material and the side profiles can be formed by etching the side profiles 32, 46 along identical crystalline planes of a single crystal semiconductor material.

In FIG. 1, a plurality of pockets 30 for mounting the TIJ chips 40 are illustrated. However, the self-aligned interconnect 10 can include one pocket 30 for mounting one TIJ chip 40. Alternatively, and as shown, the self-aligned interconnect 10 can include a plurality of pockets 30 in which a plurality of TIJ chips 40 may be mounted.

The self-aligned interconnect 10 shown in FIG. 1 shows a mounted TIJ chip 40 substantially self-aligned with a z-plane of the substrate 20. Perfect or near perfect self-alignment in x-plane and the y-plane results from the complimentary first side profiles 32 and the second side profiles 46 as discussed above. However, differences in the thickness of the TIJ chip 40 can result in variations in a height of the mounted TIJ chips 40 relative to substrate 20. Consequently, the mounted TIJ chips 40 are substantially self-aligned with the z-plane, but may vary slightly in height relative to the z-plane. The variations in height can be minimized or eliminated by selecting the TIJ chips 40 from the same substrate material as the substrate 20. For instance, each TIJ chip 40 can be selected from a same wafer or slab of semiconducting material. The semiconducting material may be selected for uniformity of thickness. Another factor that can create variation in height is etching the side profiles. For example, variations in etch temperature, time and etch solution concentration can effect the etch rate and ultimately the z-direction fit of the TIJ chips 40 in the substrate 20. The etching process will be discussed in more detail below.

Figure 2:
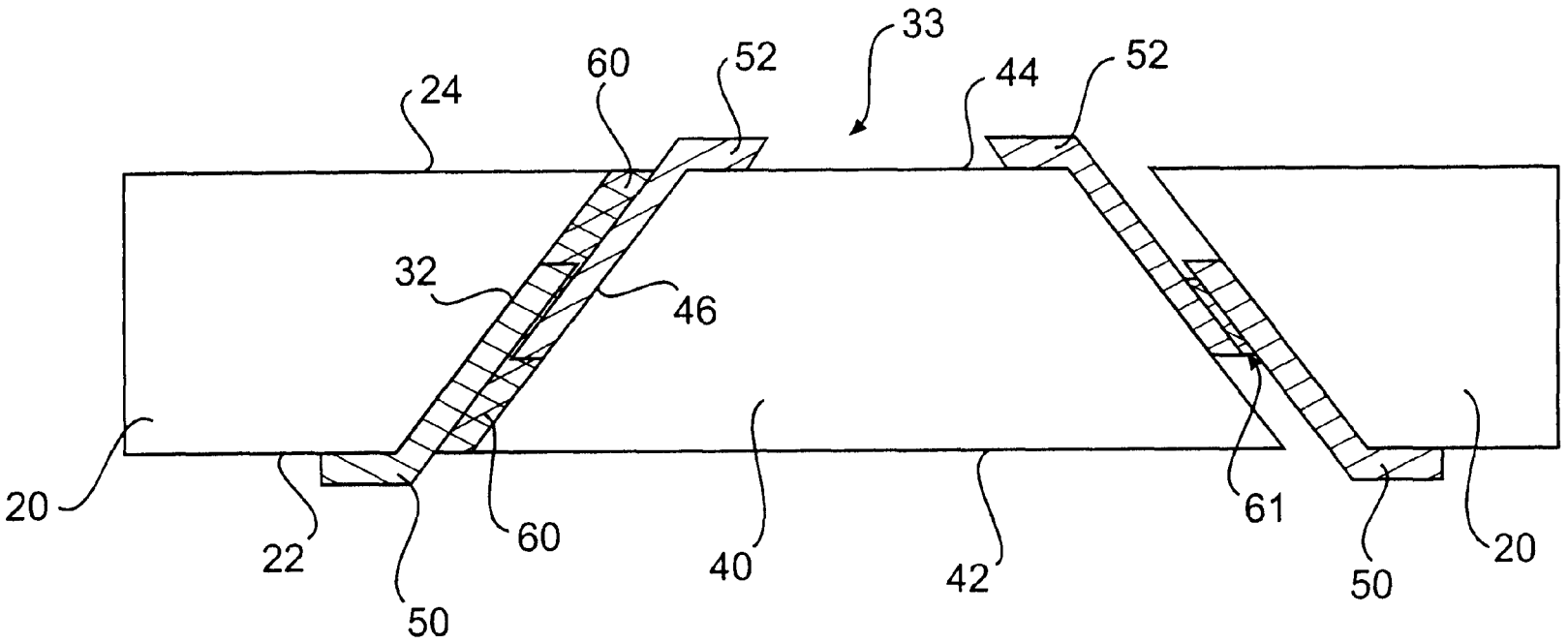
FIG. 2 is a cross-sectional side view of the self-aligned interconnect of FIG. 1.

FIG. 2 is a side cross-sectional view of the self-aligned interconnect 10 showing the substrate 20 in cross-section and the TIJ chips 40 in the cross-section. Also shown in FIG. 2 are electrical connections 50, adhesive or glue 60, and solder 61. As shown in FIG. 2, the first side profile 32 of the pocket 30 and the second side profile 46 of the TIJ chip 40 compliment each other, as was discussed above. Consequently, when the TIJ chip 40 is completely inserted into the pocket 30, and the second side profile 46 is mated to the first side profile 32, the TIJ chip 40 position is in near perfect self-alignment with the substrate 20.

In an embodiment, the pocket 30 can extend between the mounting surface 22 of substrate 20 and the topside surface 24, thereby forming an aperture 33 (see FIG. 1) in the topside surface 24. For example, if the TIJ chip 40 is for an inkjet printhead, then the aperture 33 can be used, in conjunction with the TIJ chip 40 and an ink supply (not shown) to supply ink for printing. The aperture 33 can also be used to expose the TIJ chip 40 so that electrical connections or a thermal sink can be connected to the TIJ chip 40.

The substrate electrical wiring 50 and corresponding TIJ chip wiring 52 shown penetrate the aperture 33 of the pocket 30 such that electrical connections are provided where the TIJ chip wiring 52 and the substrate wiring 50 coincide and on the substrate bottom side 22 and the chip top side 44. Such an arrangement may be advantageous in an inkjet printer application. In this embodiment, the electrical connections between the wiring 50 and 52 may be provided by the tight fit of the TIJ chip 40 in the pocket 30. Alternatively, the electrical connection between the substrate wiring 50 and the TIJ chip wiring 52 may be provided by use of the solder 61, as shown in FIG. 2. Each pair of wire leads (i.e., each pair of wiring 50 and 52) may be individually soldered using the solder 61. The gap between the profiles 32 and 46 may be sealed by adhesive or glue 60, or by localized chemical vapor deposition (CVD) with either laser or localized heating as the CVD energy source. Routing electrical wiring away from the substrate top side 24 may be advantageous because such routing minimizes wiring exposed to the corrosive effects of atomized inks.

In another embodiment, the substrate 20 and the TIJ chip 40 are made from a single crystal semiconductor material. The single crystal semiconductor material is preferred because the material is adapted to being chemically machined (etched) along known crystalline planes. Accordingly, the first side profile 32 of the pocket 30 and the second profile 46 of the TIJ chip 40 are formed by etching those side profiles 32, 46 along identical crystal planes of the single crystal semiconductor material. The first side profile 32 and the second side profile 46 can be formed by an anisotropic etch process that uses successive dilute layers of etch fluid to etch the single crystal semiconductor material. Where the waste material is etched depends to a large extent on which crystalline planes are exposed to the etchings. For example, a gallium arsenide (GaAs) substrate will etch faster along the (111) arsenic (As) crystalline plane of the substrate than any along other crystalline plane. Anisotropic differential etching processes and materials are well known in the art. The an isotropic etch process used will depend on the type of singe crystal semiconductor material and on the type of etching used. For example, some etchings are more suitable for etching silicon (Si) and other etchings are more suitable for etching gallium arsenide (GaAs).

As noted above, in an embodiment, the substrate 20 and the TIJ chip 40 are made from a single crystal silicon. The first side profile 32 of the pocket 30 and the second side profile 46 of the TIJ chip 40 are formed by etching both side profiles along identical crystalline planes of crystal silicon. Preferably, the single crystal silicon is a (100) silicon (Si) substrate obtained by cutting a length-wise (100) Si substrate from a (110) Si. A large (100) Si wafer can be used as a starting material for the substrate 20.

Typically, the Silicon ingot is formed by touching a single crystal silicon seed, in this case a 110 seed, to a melt surface and then slowly pulling the seed upward to grow the 110 Si ingot from the melt. The resulting 110 Si ingot can then be cut length-wise into thin slices by a diamond saw to form a raw (100) Si substrate. Alternatively, the resulting 110 Si ingot can be cut vertically to provide the 100 crystal plane. The surfaces of the raw (100) Si substrate are then lapped, etched, and heat treated, followed by polishing, cleaning and inspection. The result is a finished (100) Si substrate. The finished (100) Si substrate can be of different grades of quality. For microelectronic applications, the finished (100) Si substrate, provided certain critical characteristics are satisfied (e.g. purity, flatness), is referred to as a prime wafer. However, for the substrate 20 shown in FIG. 1, a lower grade test wafer or monitor wafer (100) Si substrate can be used. The shape of the (100) Si substrate need not be in the shape of a typical semiconductor wafer (i.e., substantially round). Preferably, the shape of the (100) Si substrate is rectangular. The grade of the finished (100) Si substrate selected for the chip will be application specific. For example, if the chip is for a thermal inkjet printhead, the prime wafer grade can be selected for the TIJ chip 40. On the other hand for applications that do not require a microelectronic fabrication, a lower grade, such as the test wafer or monitor wafer grade, can be selected for the TIJ chip 40. The size (length and width) of the (100) Si substrate depends on the size of the (110) Si ingot. For example, the (100) Si substrate can be from eight inches long to over seventy two inches long. Longer lengths for the (100) Si substrate may require the substrate be made thicker to mechanically support itself. Although the above discussion has focused on a (100) Si substrate, all the crystalline material may be used for the substrate 20.

Figure 3:
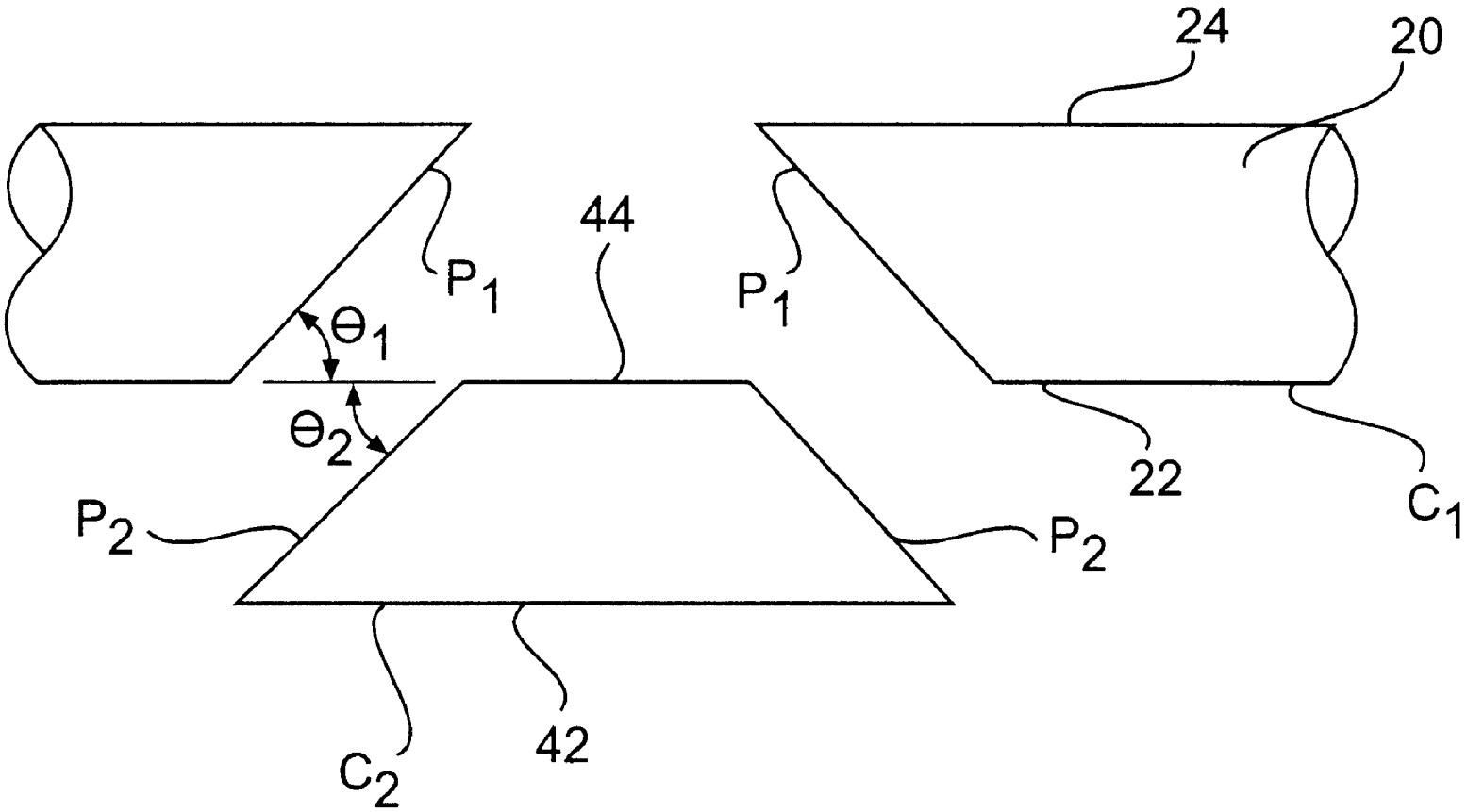
FIG. 3 shows the assembly of the substrate and the matching chips.

Referring to FIG. 3, in an embodiment, the mounting surface 22 of the substrate 20 has a (100) crystalline orientation C and the base surface 42 of the TIJ chip 40 has a (100) crystalline orientation $C_2$. Therefore, $C_1=C_2$ because both surfaces (22 and 42) have the (100) crystalline orientation. The (100) crystalline orientation for the mounting surface 22 and the base surface 42 can be obtained by selecting a (100) single crystalline plane for the substrate 20 and the TIJ chip 40. The pocket 30 and the TIJ chip 40 are formed by preferentially etching exposed portions of the mounting surface 22 and the base surface 42. The resulting side profiles $P_1$ and $P_2$ respectively match the orientation of the etched crystalline planes. The first side profile 32 is formed by etching the mounting surface 22 along the (111) crystalline plane and the second side profile 46 is formed by etching the base surface 42 along the (111) crystalline plane. The crystal dissolution by chemical etching is slowest along the (111) crystalline plane. As a result, a selective etchant will preferentially etch orientation substrates by exposing the (111) crystalline planes. The etch rate along the (100) crystalline plane is one to two orders of magnitude greater than the etch rate along the (111) crystalline plane. In an embodiment, as illustrated in FIG. 3, the (111) crystalline plane of the first side profile 32 intersects the mounting surface 22 at an angle $\theta_1$ of about 54.74° and the (111) crystalline plane of a second side profile 46 intersects the base surface 44 at an angle $\theta_2$ of about 54.74°.

The first 32 and second 46 side profiles can be formed by an anisotropic etch process. Suitable materials for the anisotropic etch process include tetramethyl ammonium hydroxide (TMAH) and potassium hydroxide (KOH). Hydrogen bubbles in the TMAH can result in formation of pyramids on the first 32 and second 46 side profiles. The hydrogen bubbles cling to the surface of the silicon and mask the surface beneath the bubbles from the etchant. The pyramids can be removed by using a higher concentration of TMAH, preferably from about 5 weight percent to about 7 weight percent. The formation of the pyramids can be completely eliminated by adding from about 5 grams per liter to about 10 grams per litter of either potassium (K) or ammonium peroxydisulfate to the TMAH.

Figure 4:
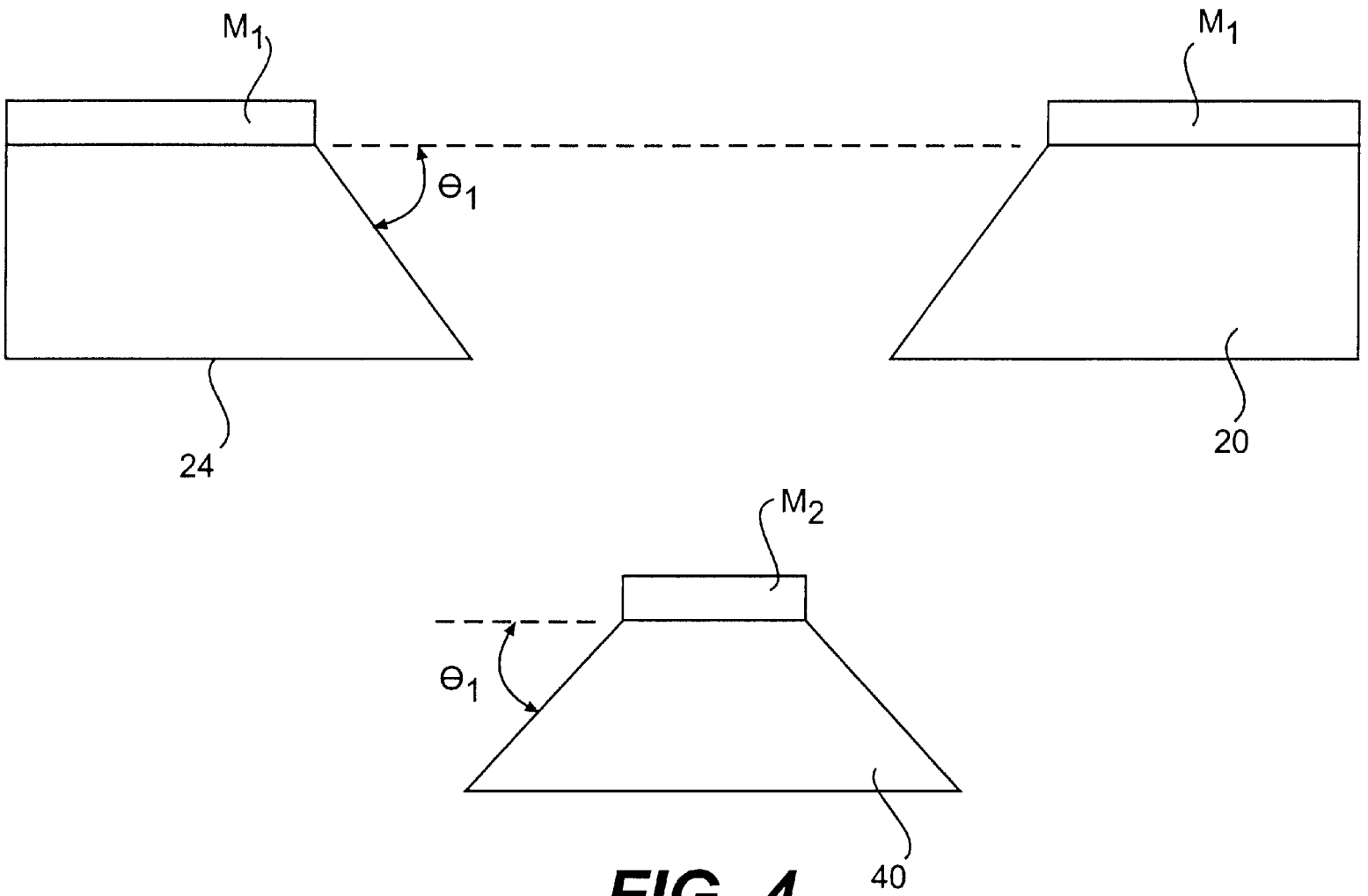
FIG. 4 illustrates an etching process.

FIG. 4 shows an embodiment of the etching process. In FIG. 4, the TIJ chip 40 is etched from a substrate by masking a portion of the base surface 42 with an etch resistant mask $M_2$, thereby exposing the unmasked portion of the substrate to the etchant. The entire substrate is subjected to an anisotropic etch process that dissolves the substrate in the area not covered by the mask $M_2$. The result is the TIJ chip 40. Similarly, the pocket 30 is etched into the mounting surface 22 of the substrate 20 by masking those portions of the mounting surface 22 that are not to be etched, with an etch resistant mask $M_1$. The entire substrate 20 is subjected to an anisotropic etch process that dissolves the substrate 20 in the areas not covered by the mask $M_1$. The result is the pocket 30.

Photolithography methods common to semiconductor manufacturing can be used to pattern and etch the masks $M_1$ and $M_2$ To ensure the features on the masks are aligned with the (111) crystalline plane of the substrate 20, at least one pre-etched pit (not shown), can be etched into the substrates to identify the proper orientation of the (111) crystalline plane relative to the (100) orientation of the substrates.

Patterning interconnect lines on the side profiles 32 and 46 created by the wet anisotropic etching requires attention. Conventional spin coating of liquid photoresist on a slope will result in a thicker photoresist at the bottom of the slope and a thinner photoresist at the top of the slope. Consequently, after photolithographic ultraviolet exposure, the width of the conductor at the bottom of the slope will tend to be wider and the width of the conductor and the top of the slope will be much narrower than that designed in the mask. Furthermore, the conductor at the top of the slope can be so thin that the conductor becomes open after the photoresist developing process. Adequate step coverage of liquid photoresist can be achieved by spray coating of atomized photoresist droplets on to slowly spinning substrates. Excellent conformal coating of the slope can be achieved by electrophoretic coating of photoresist on to the substrate. Since the photoresist is surface activated by the plating voltage, coverage of the photoresist is independent of the surface topography of the substrate.

If the substrate 20 is etched from the bottom (mounting) surface 22 and the TIJ chip 40 is etched from the base surface 42, the two parts would have identical side profiles (32 and 46). Ideally, the TIJ chips 40 would then drop into the pockets 30 of the substrate 20 with no need for further alignment. However, friction between the TIJ chip 40 and the substrate 20 may prevent complete mating. One possible way to ensure proper assembly of the TIJ chip 40 and the substrate 20 is to use an adhesive (such as the adhesive 60 shown in FIG. 2), which may have a low viscosity, as a lubricant. In addition, a vacuum may be applied to the structure to squeeze the adhesive into a thin layer. After the TIJ chip 40 and the substrate 20 are mated, any gaps between the TIJ chip 40 and the substrate 20 can be filled using the adhesive. The adhesive 60 seals the peripheral gap and retains the TIJ chip 40 in the pocket 30. If the chip is an inkjet printhead (i.e. a TIJ chip), then sealing the peripheral gap may prevent the TIJ chip 40 from being pushed out of the pocket 30 by ink (not shown) supply to the printhead. Use of the adhesive will also prevent ink from leaking through the peripheral gap between the TIJ chip 40 and the substrate 20. Alternatively, solder may be used in place of the adhesive.

The self-aligned interconnect 10 shown in FIG. 1 has significant advantages over prior art applications. In particular, by using backside interconnection, signals can be routed to the backside of the TIJ chips 40, and thereby improving reliability of the TIJ circuit. Shorting of interconnection wires by corrosion due to link leakage to the exposed interconnect wires is a major failure mode of current TIJ devices, and is eliminated using the assembly shown in FIGS. 1–4.

What is claimed is:

1. An interconnect for an electronic device, comprising:

a substrate, comprising:

a top surface, a bottom surface, and one or more pockets formed in the substrate, wherein one or more pockets includes an opening in the bottom surface, and wherein the one or more pockets include first side surfaces machined to a first slope; and one or more microelectronic chips, wherein one or more of the one or more electronic chips is inserted into one of the one or more pockets, and wherein the one or more electronic chips includes:

a base surface, and second side surfaces, wherein a slope of a second side surface matches the first slope of the first side surface.

2. The interconnect of claim 1, wherein the substrate further comprises first wiring patterned on the substrate at one or more of the pockets, wherein one or more of the chips comprises patterned second wiring, and wherein when a chip is emplanted in a pocket, the patterned first and second wiring substantially coincide.

3. The interconnect of claim 1, wherein the one or more chips and the substrate are made from a single seed silicon crystal.

4. The interconnect of claim 1, wherein the first and the second side profiles are etched along identical crystalline planes.

5. The interconnect of claim 4, wherein the etching is along the (111) crystalline plane.

6. The interconnect of claim 1, further comprising an adhesive placed between the first and the second side profiles.

7. The interconnect of claim 1, wherein the interconnect is an inkjet printer, the chips are thermal inkjet printhead chips, and the substrate receives ink at the bottom surface.

8. A self-aligned interconnect for an inkjet printer, comprising:

means for supporting one or more devices, wherein the devices are in electrical connection with the supporting means, and wherein the supporting means comprises first alignment means for aligning the devices and the supporting means; and means for distributing ink, comprising second alignment means, wherein the second alignment means coincides with the first alignment means to align the devices in the supporting means.

9. The self-aligned interconnect of claim 8, wherein the supporting means further comprises one or more pockets, and wherein the one or more devices are mounted in the one or more pockets.

10. The self-aligned interconnect of claim 9, wherein the first alignment means comprises etched sides of the one or more pockets.

11. The self-aligned interconnect of claim 10, wherein the second alignment means comprises etched sides of the one or more devices.

12. The self-aligned interconnect of claim 11, wherein the etched sides of the one or more pockets comprise a first side profile having a first angle, and wherein the etched sides of the one or more devices comprise a second profile having a second angle, and wherein the first angle and the second angle coincide.

13. The self-aligned interconnect of claim 8, wherein the supporting means, further comprises:

a top side;

a bottom side; and first patterned wiring on the bottom side, wherein one or more of the devices comprises a base surface and a top surface, the top surface having second patterned wiring corresponding to the first patterned wiring, and wherein the base surface is capable of communication with an ink supply, and wherein the first and the second patterned wiring coincide to form an electrical connection.

14. The self-aligned interconnect of claim 8, wherein the supporting means and one or more of the devices is cut from a single silicon crystal.

15. The self-aligned interconnect of claim 14, wherein the supporting means and one or more of the devices are etched along a same crystalline plane.

16. The self-aligned interconnect of claim 8, further comprising means for adhering the one or more devices to the supporting means.

17. A method for producing a self-aligned interconnect, comprising:

etching a first substrate along a first crystal plane, wherein an area to be etched is masked with a first mask, the first mask defining a pocket having an aperture with a first area in the first substrate, the first substrate comprising a substrate top surface, a substrate bottom mounting surface, and first side profiles;

etching a second substrate along the first crystal plane, wherein the an area to be etched is masked with a second mask, the second mask defining a surface area corresponding to the first area, the etched second substrate comprising a microelectronic chip having a chip base surface, a chip top surface, and second side profiles;

forming wiring connections on the substrate bottom surface and the chip top surface; and placing the chip in the pocket, wherein the first and the second side profiles correspond.

18. The method of claim 17, wherein the first crystal plane is the 111 plane, and wherein the first and the second substrates are provided from a single silicon crystal, the crystal cut in a length-wise direction to produce the first and the second substrates.

19. The method of claim 17, further comprising providing an adhesive between the chip and a surface of the pocket, wherein the adhesive can be a glue or a deposit from a localized chemical vapor deposition (CVD).

20. The method of claim 17, further comprising soldering the wiring connections to provide an electrical connection.

* * * * *